US008967067B2

(12) United States Patent
Soreau et al.

(10) Patent No.: US 8,967,067 B2
(45) **Date of Patent: *Mar. 3, 2015**

(54) SYSTEM FOR LAUNCHING AND RECOVERING UNDERWATER VEHICLES, NOTABLY TOWED UNDERWATER VEHICLES

(75) Inventors: Didier Soreau, Ville (FR); Olivier Jezequel, Saint Thonan (FR); Michaël Jourdan, Plouzane (FR)

(73) Assignee: Thales, Neuilly sur Seine (FR)

( * ) Notice: Subject to any disclaimer, the term of this patent is extended or adjusted under 35 U.S.C. 154(b) by 206 days.

This patent is subject to a terminal disclaimer.

(21) Appl. No.: 13/489,399

(22) Filed: Jun. 5, 2012

(65) Prior Publication Data

US 2013/0025521 A1 Jan. 31, 2013

Related U.S. Application Data

(63) Continuation-in-part of application No. 13/311,885, filed on Dec. 6, 2011, now Pat. No. 8,752,494.

(30) Foreign Application Priority Data

Dec. 7, 2010 (FR) ..... 10 04764
Jun. 1, 2012 (FR) ..... 12 01573

(51) Int. Cl.
*B63B 23/32* (2006.01)
*B63B 27/14* (2006.01)
(Continued)

(52) U.S. Cl.
CPC ..... *B63B 23/32* (2013.01); *B63B 27/143* (2013.01); *B63B 27/36* (2013.01); *B63C 3/02* (2013.01); *B63B 2027/165* (2013.01)
USPC ..... 114/259; 114/258

(58) Field of Classification Search
CPC ..... B63B 23/32; B63B 27/36; B63B 35/40
USPC ..... 114/258, 259
See application file for complete search history.

(56) References Cited

U.S. PATENT DOCUMENTS 2,568,330 A * 9/1951 Flippin ..... 114/382
3,508,510 A * 4/1970 Frankel ..... 114/260
(Continued)

FOREIGN PATENT DOCUMENTS

DE 3534257 A1 * 4/1987 ..... B63B 23/28
DE 3938188 A1 * 2/1991 ..... B63B 23/40
(Continued)

*Primary Examiner* — Lars A Olson
*Assistant Examiner* — Jovon Hayes
(74) *Attorney, Agent, or Firm* — Baker Hostetler LLP

(57) ABSTRACT

A system for automatically launching and recovering marine or underwater vehicles from a carrier ship which remains under way to limit pitching and rolling movements. The system includes an inclinable articulated ramp including a bottom and edges, and hauling means for controlling sliding of the vehicle along the ramp during launch and for hoisting the vehicle up along the ramp during recovery. The ramp has a free end which varies between an immersed position in water and an emerged position in a horizontal position. The system includes buoyancy means allowing the free end of the ramp to float at the surface or near the surface of the water when lowered. The bottom of the articulated ramp also has an external face that is configured to form streamlining ensuring fluidity of the end of the ramp with the water and limiting vertical dynamic movements caused by waves.

13 Claims, 10 Drawing Sheets

(51) Int. Cl.

| | |
|---|---|
| ***B63B 27/36*** | (2006.01) |
| *B63C 3/02* | (2006.01) |
| *B63B 27/16* | (2006.01) |

(56) References Cited

U.S. PATENT DOCUMENTS

| | | | | |
|---|---|---|---|---|
| 3,596,623 | A * | 8/1971 | Frankel | 114/259 |
| 4,165,703 | A | 8/1979 | Burg | |
| 4,876,979 | A * | 10/1989 | Walton et al. | 114/258 |
| 5,253,605 | A * | 10/1993 | Collins | 114/259 |
| 5,394,583 | A * | 3/1995 | Plate | 14/69.5 |
| 6,779,475 | B1 * | 8/2004 | Crane et al. | 114/258 |
| 6,843,198 | B1 * | 1/2005 | Witbeck | 114/258 |
| 6,955,519 | B1 * | 10/2005 | Ferderber | 414/680 |
| 7,059,564 | B2 * | 6/2006 | Dennis | 244/110 F |
| 7,156,036 | B2 * | 1/2007 | Seiple | 114/254 |
| 7,546,814 | B1 * | 6/2009 | Said | 114/259 |
| 7,581,507 | B2 * | 9/2009 | Kern | 114/259 |
| 7,712,429 | B1 * | 5/2010 | Gibson et al. | 114/312 |
| 2008/0202405 | A1 * | 8/2008 | Kern | 114/259 |
| 2012/0192780 | A1 * | 8/2012 | Soreau et al. | 114/259 |
| 2013/0025521 | A1 * | 1/2013 | Soreau et al. | 114/259 |

FOREIGN PATENT DOCUMENTS

| | | | | |
|---|---|---|---|---|
| GB | 1204656 | | 9/1970 | |
| GB | 2081212 | A * | 2/1982 | B66C 13/02 |
| GB | 2081212 | A1 | 2/1982 | |

* cited by examiner

SYSTEM FOR LAUNCHING AND RECOVERING UNDERWATER VEHICLES, NOTABLY TOWED UNDERWATER VEHICLES

CROSS-REFERENCE TO RELATED APPLICATIONS

This application is a continuation-in-part of U.S. patent application Ser. No. 13/311,885, which claims priority to foreign French patent application No. FR 10 04764, filed on Dec. 7, 2010. This application claims priority to foreign French patent application No. FR 12 01573, filed on Jun. 1, 2012. The disclosures of each of the above-noted applications are incorporated by reference in their entireties.

FIELD OF THE INVENTION

The invention falls within the naval field and relates more specifically to the handling and lifting systems mounted on ships for launching and recovering marine or underwater vehicles from these ships, the vehicles in question being either towed vehicles or self-propelled vehicles, the latter then being fitted with a temporary tether while they are being launched and recovered.

The operations of launching and recovering a marine or underwater vehicle from a ship which also has the task of transporting this vehicle generally include a phase that is critical, especially in rough seas, which is the transition from the fully emerged state in which the vehicle is secured to the handling means used, to the fully immersed state in which the vehicle has no further contact with these means, and vice versa. This is because it is during these critical phases that the movements of the swell are most dangerous to the integrity of the vehicle, this vehicle being tossed about by the swell while it is in a region on the surface where it is likely violently to strike either the structure of the ship or that of the lifting and handling means.

This is particularly true of a self-propelled vehicle in the launch or recovery phase when, with the vehicle already in the water or still in the water, the lifting and handling means do not yet (or any longer) have full control over its movements. This is also true of a towed vehicle in the phases in which the towing cable is holding it near the hull of the ship while the lifting and handling means have not yet (or any longer) got full control over its movements.

BACKGROUND

To limit these risks of collision there are known solutions, which generally employ means that involve the intervention of human operators.

Thus, as far as the self-propelled vehicles are concerned, these not being towed by the ship, one known solution is to provide mooring means on the hull of the vehicle, for example securing rings, these securing means being arranged in such a way that the vehicle can be lifted while maintaining a horizontal position. Launch and recovery can then, for example, be performed using a winch mounted on a mobile gantry positioned at the rear of the ship, or even a crane, the gantry or the crane allowing the lifting winch to be positioned over the recovery zone. As a result, launch and lift are performed vertically, thus limiting the possibilities of collision with the ship during lowering or raising. As an alternative, the vehicle can be lifted by placing it in a gondola-like device which itself comprises suitable fixing points.

This type of solution can be applied, notably autonomously, to vehicles towed from the middle but is not, however, readily applicable to the case of vehicles that are towed from the front because, for obvious reasons of efficiency, it is desirable for it to be possible for the vehicle to be towed and handled using the one same cable. Handling using means such as those described hereinabove using a single cable would prove tricky because it entails the vehicle passing from the vertical position to the horizontal position during launch and vice versa during recovery. This handling further requires additional operations the purpose of which, once the vehicle has been lifted and positioned over the deck of the ship, is to lay the vehicle down flat on the deck of the ship or, more generally, on a storage area. These operations themselves generally require the intervention of human operators, which intervention is made trickier and more hazardous when the sea is rough.

As a result, as far as vehicles towed from the front are concerned, the solution generally preferred is to use a handling cable secured temporarily above the centre of gravity of the vehicle.

Another solution that is also used is handling based on the installation of means comprising an inclined ramp along which the vehicle slides in order to reach the surface of the water or leave the water and return to the ship. The ramp is generally configured so that it guides the vehicle in a straight path, thus avoiding the vehicle having to follow a lateral course. However, such a ramp is generally ill suited to use in heavy seas, because lateral movements of the vehicle could then damage that vehicle.

The use of such means advantageously allows the vehicle to be launched and deployed at the rear of the ship in a simple way by letting the towing cable out and, conversely, allows the vehicle to be returned on board the ship simply by winding the cable in, onto the drum of a winch for example. The launch and recovery of the vehicle can therefore moreover be performed while the ship is under way, which means that the vehicle, towed by the ship, naturally positions itself along the line of forward travel of the ship.

Nonetheless, the use of such means involves a critical phase which occurs between the moment the vehicle comes into contact with the ramp and the time it is fully in position thereon. Specifically, the transition of the vehicle from the surface of the water to the ramp involves the nose of the vehicle coming into contact with the ramp, and this contact, notably when the sea is rough, can be fairly violent and cause damage to the vehicle but also prevent the vehicle from being brought up.

In order to alleviate these difficulties of initial contact, various solutions have been developed, which solutions are generally best suited to one given type of vehicle. These known solutions generally involve reinforcing the structure of the vehicle, mainly the nose, so that it is able to withstand the knocks resulting from its coming into contact with the end of the ramp. It also involves the use of means for minimizing these impacts, particularly by configuring the ramp in such a way that its end lies beneath the surface of the water so that the vehicle floating on the surface comes into contact with the inclined surface of the ramp rather than with the end thereof. Such solutions nonetheless prove to be insufficient in rough seas, the slamming effect of the waves then being heightened by the movement of the ship.

SUMMARY OF THE INVENTION

It is one object of the invention to propose means for launching and recovering a marine or underwater vehicle in the safest possible way, it being possible for these means to be deployed entirely automatically, with no human intervention or monitoring. A more particular object of the invention is to provide means suited to the handling of underwater vehicles that are towed from the front or of underwater vehicles that do not have any means of vertical lifting but which are temporarily connected to hauling means, a cable driven by a winch for example, during the launch and recovery phases.

To this end, the subject of the invention is a system for automatically, even in rough seas, launching and recovering a marine or underwater vehicle from an under way carrier ship, of the type comprising an inclinable articulated ramp comprising a bottom and edges, first drive means for lowering and raising the ramp and hauling means for controlling the sliding of the vehicle along the ramp during the launch and for hoisting the vehicle up along the ramp during recovery, the ramp having an emerged end and an end intended to be immersed, the ramp being able to move in terms of rotation with respect to the carrier ship about a rotation axis, known as the rotation axis of the ramp, under the action of the first drive means. The rotation axis of the ramp is located at a distance from the emerged end and from the end intended to be immersed. The ramp also comprises buoyancy means configured and arranged on the ramp in such a way that the free end of the ramp floats at the surface or near the surface of the water when the ramp is lowered. The bottom of the articulated ramp has an external face that forms streamlining so as to minimize the lift and drag forces imparted to the ramp by the movement of the ship and the vertical dynamic movements brought about by the waves when its free end is in contact with the water.

Advantageously, the rotation axis of the ramp is located between the emerged end and the end intended to be immersed.

Advantageously, the edges of the ramp are configured so that they, jointly with the streamlining of the lower part of the ramp, provide the free end of the ramp with buoyancy.

Advantageously, the edges of the ramp are configured to hold the vehicle on the ramp and limit the rolling movements imparted to the vehicle.

Advantageously, the system further comprises holding and guiding means comprising a holding device configured to hold the end of the vehicle and remain in contact with the vehicle during the launch and recovery operations, the holding device being driven with the vehicle by the hauling means.

Advantageously, the hauling means comprise a towing cable driven by hauling means.

Advantageously, the system includes means for changing the direction of the cable.

Advantageously, the bottom has a slot, through which the cable is able to pass.

Advantageously, the means for changing the direction of the cable include a pulley that has a pulley axis coincident with the rotation axis of the ramp.

Advantageously, the means for changing the direction of the cable include a cylinder portion that has an axis coincident with the rotation axis of the ramp.

Advantageously, the holding device comprises vertical protection elements on which the wings of the vehicle rest when its end is engaged in the holding device, the frontal support thus afforded contributing to keeping the vehicle along the axis of the ramp.

Advantageously, the holding and guiding means further comprise drive means configured to keep the holding device in contact with the end of the vehicle as long as the vehicle is progressing along the ramp.

Advantageously, the bottom has a V-shaped or W-shaped cross-sectional profile.

Advantageously, the rotation axis of the ramp is able to undergo translational movement with respect to the ship, between a first position and a second position located in front of the first position with respect to the ship.

Advantageously, the system includes damping means on which the part of the ramp that is located between the end that can be immersed and the rotation axis can rest when the ramp is in the second position.

The device according to the invention thus consists of a recovery system that advantageously limits the vertical relative movements between this system and the underwater or marine vehicle when this vehicle is floating at the surface, particularly at the critical moment of contact between these two entities during recovery. It allows the vehicle to be launched automatically from its storage position and then allows this vehicle to be recovered following use and returned to its storage position.

The vertical relative movements are successfully limited by means of an inclinable ramp that is articulated in its upstream part and that in its rear part comprises buoyancy means that allow its free end to float at the surface. Moreover, the streamlined underside of the ramp advantageously limits the impact of the speed of forward travel of the ship and the slamming effects due to the waves on the relative positioning of the rear end of the ramp with respect to the surface of the water, and does so for different sea conditions and different speeds of travel in relation to the water.

BRIEF DESCRIPTION OF THE DRAWINGS

The features and advantages of the invention will be better assessed through the description which follows, which description introduces one particular embodiment which embodiment does not limit the scope of the invention. This description relies on the attached figures which depict.

DETAILED DESCRIPTION OF THE INVENTION

In the rest of the text, the terms front, rear, in front of and behind are defined with respect to the ship, and more precisely with respect to the longitudinal axis of the ship, extending from the rear to the front of the ship.

As stated earlier, the description which follows introduces a number of embodiments of the device according to the invention, which embodiments do not limit the scope of the invention. These embodiments introduce both the essential features of the invention and additional features connected with the embodiments in question.

Figure 1:
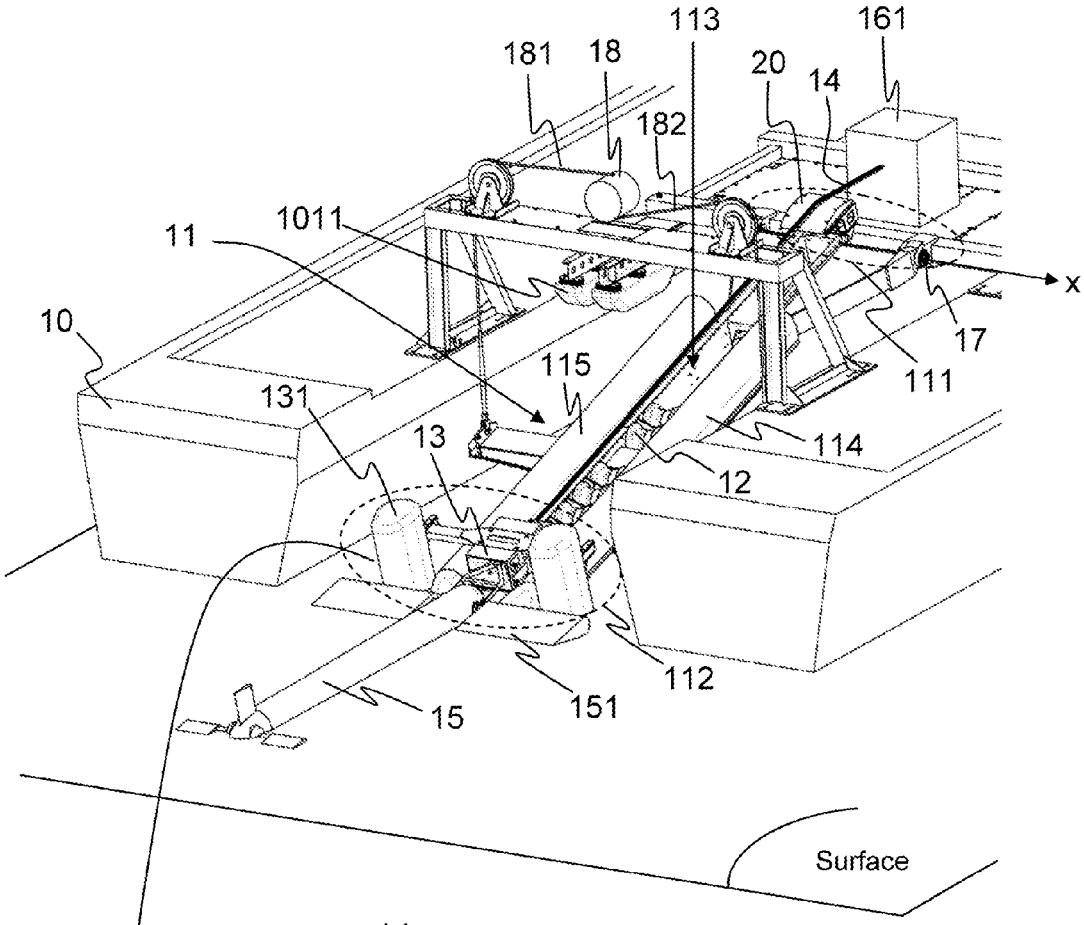
FIG. 1, and FIG. 1*a* a schematic overview of one particular embodiment of the system according to the invention, showing the ramp in the lowered position.
Figure 1A:
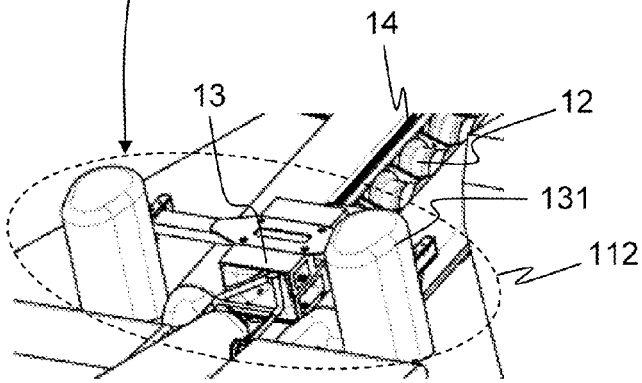

FIG. 1 shows an overview of an example of the system according to the invention. However, the arrangement of the emerged end 111 with respect to the position of the rotation axis x of the ramp, which axis x is shown in FIG. 1 and also in FIG. 3, which will be described below, is not part of the ramp that is the subject of the present invention. In this view, the device is shown on a ship 10 of the catamaran type, between the two hulls thereof. As this figure illustrates, the device according to the invention chiefly comprises the following elements:

- a streamlined articulated ramp 11 preferably situated at the rear of the ship and having a first end or emerged end 111 and a second end or free end 112. The emerged end 111 of the ramp is connected to the carrier leaving at least one degree of freedom to rotate about a horizontal axis perpendicular to the main axis of the ramp so that the free end 112, which is also known as the end intended to be immersed 112, can be raised or lowered in the manner of a drawbridge.

In other words, the ramp 11 is articulated to the ship 10 about a rotation axis x of the ramp, which axis x is perpendicular to the main axis of the ramp. In FIG. 1, the rotation axis x is located at the emerged end 111.

The rotation axis x of the ramp is horizontal.

The horizontal plane is defined by the plane of the deck of the ship. The expression "horizontal axis" is understood to mean an axis parallel to the deck of the ship.

According to the invention, the ramp 11 is in the overall shape of a chute or channel section with a bottom 113 and edges 114 and 115 the height of which is notably determined according to the size and geometry of the vehicle 15 being handled.

- means 12 mounted on the ramp and intended to encourage the vehicle to progress along the ramp under the action of the hauling performed by the cable (in the case of recovery) or under the effect of gravity (in the case of launch). These means are, for example, rollers or rolling runners positioned laterally on the bottom 113 of the ramp and over which the vehicle 15 rolls.
- holding and guiding means the function of which is to ensure that the vehicle is aligned with the axis of the ramp so as to allow the vehicle to roll or slide correctly throughout its travel along the ramp (up or down). These means include, for example, as illustrated in FIG. 1, a device 13 acting as a fairlead, through which the towing cable 14 used to haul the vehicle passes. This element is configured so that it moves along the ramp 11, for example on rails positioned along the longitudinal axis thereof (not depicted in FIGS. 1 and 3 but depicted in FIGS. 4, 7*b* and 7*d*).
- buoyancy means, the main purpose of which is to ensure that the free end 112 of the ramp can naturally remain at the surface of the water when there are no waves or when the waves have a wavelength that is long in comparison with the dimensions of the recovery system. In the embodiment of FIG. 1, these means consist of lateral floats forming the edges 114 and 115 of the ramp, and of the bottom of the ramp that forms the streamlined part. However, in an alternative embodiment, these means may simply consist of floats 30 attached to the ramp 11, to the part of the ramp that is able to be immersed, as depicted in FIGS. 4, 5, 7*a* and 7*c*, or to the free end 112, or of any other combination of suitable means. The vertical protection elements 131 can also be part of the buoyancy means. During a phase of launching the vehicle or bringing it back on board the ship, the end 151 of the vehicle, attached to the towing cable 14, is inserted into the element 13 and remains in close contact therewith, and this has the advantageous effect of keeping the axis of the vehicle along the axis of the ramp 11 as the vehicle travels along this ramp.

This enduring contact is obtained naturally inasmuch as the holding element 13 is a solid element that has a tendency, under the effect of its weight, to drop down along the ramp, thus checking the progress of the fish as it is being raised back up and assisting with its lowering.

However, in one particular embodiment, the holding and guiding means may also comprise drive means (not present in the example of FIG. 1) configured so that the holding element 13 is kept in contact with the end of the vehicle 15 as long as the latter is progressing along the ramp 11. These means work for example by applying a certain resistance to the travel of the fairlead towards the fixed end of the ramp.

According to the embodiment considered, these drive means may for example consist of an auxiliary winch which pulls the holding device 13 (the fairlead) towards the free end 112 of the ramp 11 (downward) by means of a cable returned by a pulley situated at the free end of the ramp. Adjusting the tension of the auxiliary winch in relation to the tension generated by the towing winch 16 then allows contact between the vehicle 15 and the fairlead 13 to be actively maintained as the vehicle 15 is being raised back up along the ramp 11, without, however, impeding this raising.

Alternatively, according to another embodiment, the vehicle can be secured to the holding element when its end is inserted therein. In this case, the action of drive means becomes less necessary.

Illustrations 2-*a*, 2-*b* and 2-*c* of FIG. 2 illustrate an essential feature of the invention. Illustration 2-*a* is a schematic side view of the ramp 11, in a lowered configuration for which the free end 112 is immersed in the water. This configuration corresponds to the use of the ramp for operations of launching and recovering the vehicle 15. Illustration 2-*b* shows, for the same configuration (ramp lowered), a view of the ramp with a horizontal plane of section passing through the axis $\Delta_2$ shown in the side view 2-*a*. Illustration 2-*c* on the other hand shows a view of the ramp on a vertical plane of section passing through the axis $\Delta_1$ shown on the side view 2-*a* and perpendicular to the axis of the ramp 11.

According to this feature, the bottom 113 of the articulated ramp 11 includes an external face 21 intended to come into contact with the surface of the water, which forms streamlining the cross-sectional profile of which is defined, as illustrated by views 2-*b* and 2-*c*, in such a way as to minimize the lift and drag forces caused, when the free end of the ramp is in contact with the water (ramp lowered) according to the schematic view 2-*a*, by the speed of forward travel of the ship on the one hand and so as to minimize the effect of slamming caused by the waves on the other. In other words, the profile of the external face 21 of the bottom 113 of the ramp 11 is defined so that it acts like a breakwater to break the wave front likely to collide with the ramp 11 as a result notably of the movement of the ship 10, before these waves reach the free end 112 of the ramp and, at the pace of the waves passing under the ramp 11, cause sharp variations in the vertical position of the free end 112 of the ramp 11 in relation to the surrounding water surface. These sharp variations, if not compensated for, notably result in an uncontrolled variation in the vertical position of the end 112 of the ramp 11 relative to that of the end 151 of the vehicle 15, which can cause damage to the latter if it occurs just at the moment that the vehicle enters the ramp.

In one particular embodiment, illustrated by FIG. 2, the external face 21 of the bottom 113 of the ramp 11 forms streamlining with a V-shaped cross-sectional profile. In an alternative embodiment, this face 21 forms streamlining with a W-shaped cross-sectional profile.

Advantageously, the use of a ramp 11 fitted with buoyancy means that act chiefly on the free end 112 of the ramp so as to keep the latter at a given position with respect to the water surface, either at the surface or slightly immersed for example, and the underside 21 of which has the cross-sectional profile defined hereinabove, allows two significant effects to be minimized:

- the dynamic rise of the free end 112 of the ramp 11 above the surface (surfing effect) connected with the resistance of the ramp to the forward travel of the ship and to the lift of the ramp: this phenomenon, which is a result of the speed of the ship, is likely to make it difficult for the end of the vehicle 15 to come into contact with the fairlead 13 without colliding with it, particularly during operations of recovering the vehicle 15;
- the sharp vertical dynamic movements performed by the free end 112 of the ramp 11 as a result notably of the slamming effect caused by the waves particularly when the waves are short (the combined effect of a deflection of the water and significant hydrostatic return), which movement is also likely to make it difficult for the end of the vehicle 15 to come into contact with the fairlead 13 without colliding with it, particularly during operations of recovering the vehicle 15 and which may have the additional effect of causing the vehicle to jump when installed on the ramp and of causing it to collide with the bottom of the ramp with the risk of damaging it.

The minimizing of these two effects, which has been obtained by implementing the invention, thus represents an essential factor in limiting the instances of heavy knocks between the vehicle 15 and the ramp 11, notably during the phase in which the vehicle is approaching the ramp and in which its end, hauled by the cable, is ready to enter the fairlead 13 and take up position on the ramp 11 and during the phases in which the vehicle is sliding along the ramp. This factor is particularly essential inasmuch as launch and recovery of the vehicle are performed when, in order to ensure good overall stability, the ship is still under way.

These two complementary means, the buoyancy means and the streamlining of the external face of the ramp, thus advantageously ensure a stable vertical position with respect to the surface for the rear end 112 of the ramp 11 and therefore for the holding device 13, particularly during that critical phase when the vehicle is approaching the ship 10 in order to take up position on the ramp.

Thus, by virtue of the essential features described in the foregoing text, the device according to the invention allows an underwater or marine vehicle to be recovered safely even when the ship tasked with recovering it is under way at a non-zero speed in a sea that is not calm.

The fact that the device is designed to be used from a ship under way, advantageously allows this ship to have greater manoeuvrability and limits the amplitude of its movements under the action of the movements of the sea. As a result, adopting a suitable heading facing into or out of the swell means that rolling movements can be greatly limited. The speed of forward travel of the carrier ship 10 also, as has already been stated, makes it easier to stabilize the position of the vehicle 15 along the axis of the ramp 11.

The device according to the invention also has the advantage that it can be installed on a wide variety of ships of varying shapes and tonnages. It may also, depending on the target application, in addition to comprising the essential characteristic elements described above, comprise additional elements which, for example, make it easier to operate in the target operational context.

In the embodiment of FIG. 1, the device according to the invention is, for example, positioned between the two hulls of a ship of the catamaran type, preferably towards the rear of the ship. The vehicle 15 considered here is a towed underwater vehicle with wings 151 that perform a depressing function. The size and construction of these winglets also make them relatively fragile. The vehicle 15 here is towed by means of a towing cable 14, an electric towing cable, for example, which may be wound or unwound by means of hauling means 16, 161, including a towing winch 16 shown in FIGS. 4 to 7. The system includes means 20 for changing the direction of the cable.

The system also includes means 20 for changing the direction of the cable from the hauling means 16, 161 by limiting its travel. The hauling means 16, 161 apply, to the cable, a hauling force in a predetermined hauling direction.

Furthermore, the device 13 (fairlead) locally and simultaneously ensures the functions of the means 161 and 20. According to the above explanations, the device comprises the essential constituent elements described hereinabove and, in particular, a narrow ramp 11 the width of which substantially corresponds to the cross section of the body of the vehicle, combined with buoyancy means the action of which is essentially applied to the free end of the ramp and with holding and guiding means consisting of the device 13. Likewise, the external face 21 of the bottom 113 forms streamlining. Advantageously, the ramp has a streamlined shape, which is V-shaped or W-shaped. This streamlined shape is advantageously narrow.

The streamlined shape of the external face 21 is inherently an aerodynamic shape.

In FIG. 1, the ramp 11 is mounted on the ship via fixing means 17 which allow it to pivot, with respect to the ship, about a horizontal rotation axis x perpendicular to the main axis of the ramp and also perpendicular to the longitudinal axis of the ship. The fixing means 17 are mounted on the end 111 of the ramp that faces towards the front of the ship 10, and this allows the end 112 of the ramp directed towards the rear to be free of the pitching movements of the carrier ship.

Moreover, as far as the holding and guiding means are concerned, the device (the fairlead) 13 in this example comprises vertical protection elements 131 against which the wings 151 of the vehicle rest when the end of the vehicle is engaged in the guide element 13, the support thus provided contributing towards keeping the vehicle 15 along the axis of the ramp 11.

Figure 3:
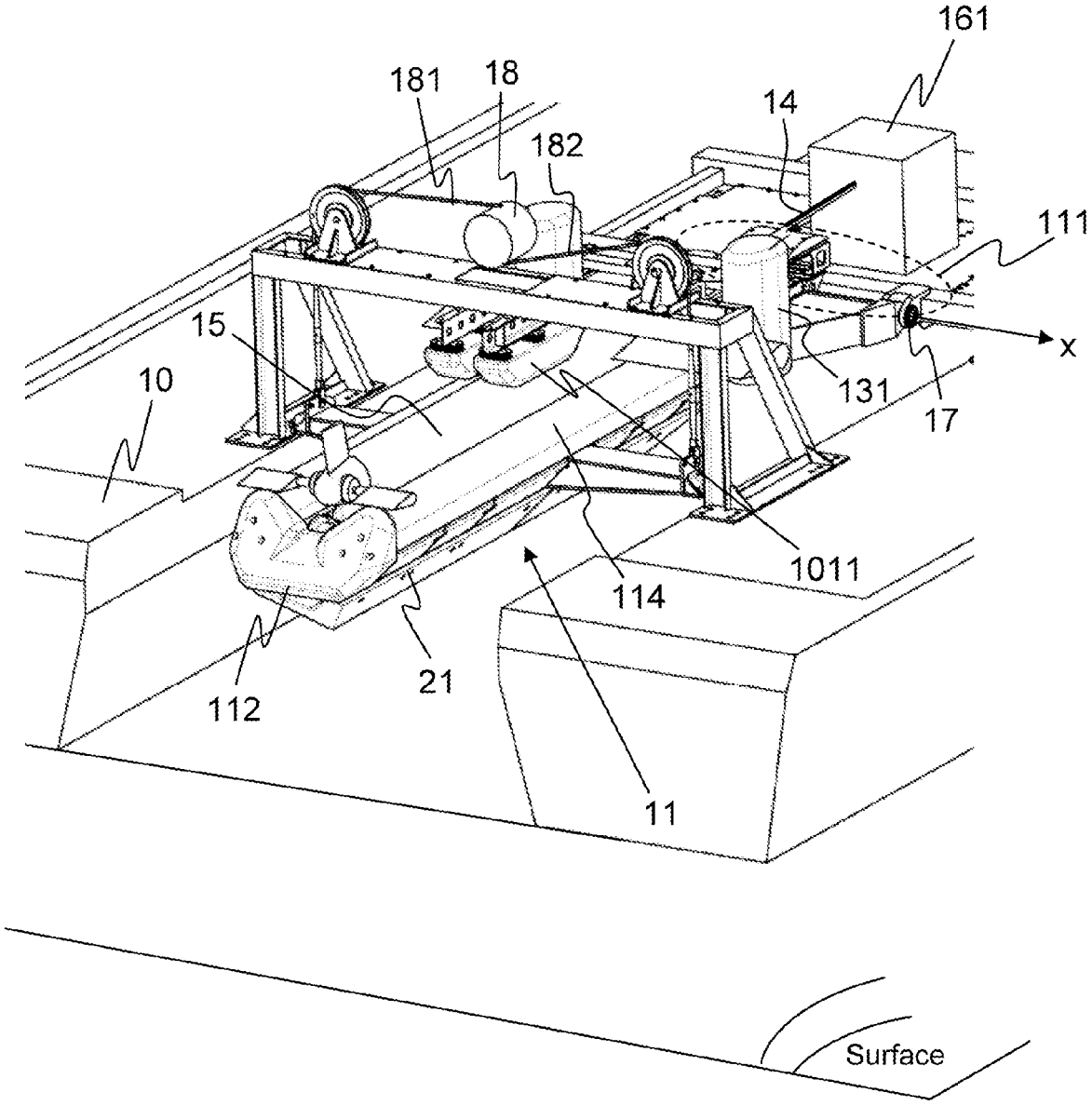
FIG. 3, a schematic overview of one particular embodiment of the system according to the invention, showing the ramp in the raised position, FIG. 4 schematically shows a side view of another example of the system according to the invention, in which the ramp is in a lowered position, FIG. 5 schematically shows a side view of another example of the system according to the invention, in which the ramp is in a lowered position, FIG. 6 schematically shows a top view of the system from FIG. 4, FIGS. 7*a* to 7*d* schematically show another example of the system according to the invention, in a side view in which the ramp is lowered (7*a*), in a top view in which the ramp is lowered (7*b*) and in which the ramp is raised and in a storage position (7*c* in a side view and 7*d* in a top view).

In the embodiment illustrated in FIG. 1, the device according to the invention also comprises lifting means allowing the free end 112 of the ramp 11 to be raised when the device is not in use, notably outside of periods of launching and recovering the vehicle and allowing the ramp 11 and, where appropriate, the vehicle 15 to be brought into a horizontal storage position illustrated in FIG. 3 above the surface of the water.

These additional lifting means may, as illustrated in FIG. 1, consist of a winch 18 which winds and unwinds two cables 181 and 182 in synchronism. The cables 181 and 182 are returned by pulleys placed on a gantry 19 and are attached on each side of the ramp 11, preferably near the free end 112. The raised position of the ramp is, for example, determined by a system of end stops positioned on the gantry. The lowered position is not itself identified by an end stop because the ramp is supposed to float.

Moreover, in this exemplary embodiment, the edges 114 and 115 of the ramp 11, in addition to being configured to make the free end 112 of the ramp 11 buoyant, are also configured to form semirigid longitudinal support elements. The thickness of the edges is therefore suited to the dimensions of the vehicle 15 concerned so that when this vehicle is installed on the ramp 11, its body rests on the means 12 while its wings 151 rest on the edges 114 and 115 along which they slide.

It should be noted that although the stability of the vertical position of the rear end 112 of the ramp with respect to the water surface is normally assured, by optimizing the hydrostatic properties (mass, volume) and the hydrodynamic properties of the ramp, through the presence of the buoyancy means and via the cross-sectional profile of the streamlined hull formed by the bottom 113 of the ramp 11, it is nonetheless possible, for certain specific applications, to supplement the action of these means by controlling the position of the free end 112 of the ramp in the vertical plane using additional means, for example rams, or even by using lifting means capable of effecting this control, it being possible for these means to be those used to raise the ramp and keep it in the raised position.

From an operational standpoint, the device according to the invention advantageously allows the operations of launching and recovering marine or underwater vehicles, particularly towed vehicles, to be carried out without any need for any human intervention for mooring or handling.

Thus, in order to recover a vehicle after use, all that is required is for the free end of the ramp 11, initially in a horizontal position, to be lowered by operating the motor 18 of the lifting means.

The ramp 11 thus lowered advantageously, thanks to the means that provide its free end 112 with buoyancy and thanks to its streamlining, keeps the holding and guiding means in position, and in particular keeps the entry to the device 13 (the fairlead) level with the surface of the sea irrespective of the height of the waves. The fairlead 13 thus follows the surface of the water just like the towed vehicle 15 floating at the surface thereof.

As a result, the vehicle 15 can be towed into a position in which it comes into contact with the fairlead 13 while these two elements are positioned substantially at one and the same height. In that way, the end of the vehicle 15 can insert itself into the fairlead 13 with a minimal risk of violent frontal and vertical collision.

Once the end of the vehicle 15 has thus been inserted into the device 13, the forward travel of the ship 10 has the effect of causing the vehicle to position itself, through inertia, along the longitudinal axis of the ramp 11. Moreover if, as in the example of FIG. 1, the device 13 is equipped with vertical protection elements 131, the fact of the wings 151 of the vehicle 15 coming into contact with these vertical elements 151 encourages the vehicle 15 to realign itself along the axis of the ramp 11 at the moment of contact with the device 13. The presence of these vertical elements further limits yawing, surging and swaying of the vehicle 15 when full contact with the device 13 is made.

Correct positioning of the vehicle with respect to the ramp now having been assured, the actual raising of the vehicle 15 up along the ramp 11 can be performed by continuing to actuate the towing winch 16, the movement of the vehicle 15 causing that of the fairlead 13 through which the towing cable 14 passes and in which its end 151 is inserted, while the wings 151 of the vehicle 15 are supported across a broad front.

The assembly thus rises up along the ramp, sliding or rolling thereon, towards the fixed end 111, the holding element 131 being kept in contact with the end of the vehicle by the drive means described earlier.

Thereafter, as the vehicle gradually ascends and emerges from the water, contact between the vehicle 15 and the ramp 11 becomes increasingly close. The ramp 11 becomes heavier which means that it swings down into the water and becomes more inclined. Collisions between the vehicle and the ramp are therefore attenuated, notably as a result of the increased angle of inclination of the ramp as a result of the weight of the vehicle. Moreover, the fact that the wings 151 are resting against the edges 114 and 115 of the ramp limits any potential rolling of the vehicle during this raising operation. Any pitching of the vehicle is itself gradually attenuated until it becomes zero when upthrust becomes insufficient to lift the vehicle in relation to the ramp 11. The vehicle 15 is then fully resting on the ramp 11 and all six of its degrees of freedom are under control.

It should be noted that in one particular embodiment suited to operation in heavy seas leading to relative vertical accelerations of more than 1 g, the device according to the invention may comprise an additional means, a rigid arm for example, that immobilizes the vehicle with respect to the holding device 13 and therefore with respect to the ramp.

According to the invention, once the vehicle 15 is completely resting on the ramp 11, it is possible to return the ramp 11 to a horizontal position using the lifting means.

Thereafter, with the vehicle 15 placed in a stable manner on the ramp 11, it is possible, by adopting a configuration known as the "transit" configuration illustrated in FIG. 3, to transport it, keeping it stored on the ramp 11. In this configuration, additional fasteners 1011 that hold the vehicle 15 firmly on the ramp 11 are used. Thus, the device according to the invention and the vehicle can, without damage, be subjected to vertical accelerations of several g.

Alternatively, if suitable handling means are available on board the ship, the vehicle can, from this stable position, be detached from the towing cable 14 and placed in a dedicated storage area. In such a case, the action of the lifting means during the transit phases is confined to keeping the ramp in the raised position.

From an operational standpoint, the manoeuvre of launching the vehicle is a manoeuvre that is the opposite of that of recovering it.

Thus, during that manoeuvre, with the vehicle 15 positioned on the ramp 11, the latter is lowered, the lifting means ensuring a controlled lowering of the free end 112 of the ramp 11 towards the surface of the water. Once the free end 112 has been fully lowered, the free part of the ramp 11, still fitted with the towed vehicle 15, floats, sinking slightly below the surface of the water at its rear end 112. Next, the towing winch 16 is actuated to release the vehicle 15 which slides along the ramp 11 under its self weight or, in the alternative form of embodiment described earlier, under the action of drive means which act on the holding device 13, until it completely leaves the ramp 11, the end of the vehicle 15 then being separated from the fairlead 13.

During the phase of releasing the vehicle, the lifting means are preferably kept under tension to prevent the lifting cables 181 and 182 which are unloaded from containing any "slack" which would be detrimental to the correct execution of the operation.

FIGS. 4 to 7 show further embodiments of the system according to the invention. In these examples, the ramp is installed on a ship 10 which is, in this case, single hulled. The elements and means described hereinabove can be integrated into the examples in FIGS. 4 to 7 except for the arrangement of the end 111 with respect to the ship and more particularly with respect to the rotation axis x of the ramp. However, some elements, such as the means 12, 1011, have not been shown in FIGS. 4 to 7 for reasons of greater clarity.

Figure 4:
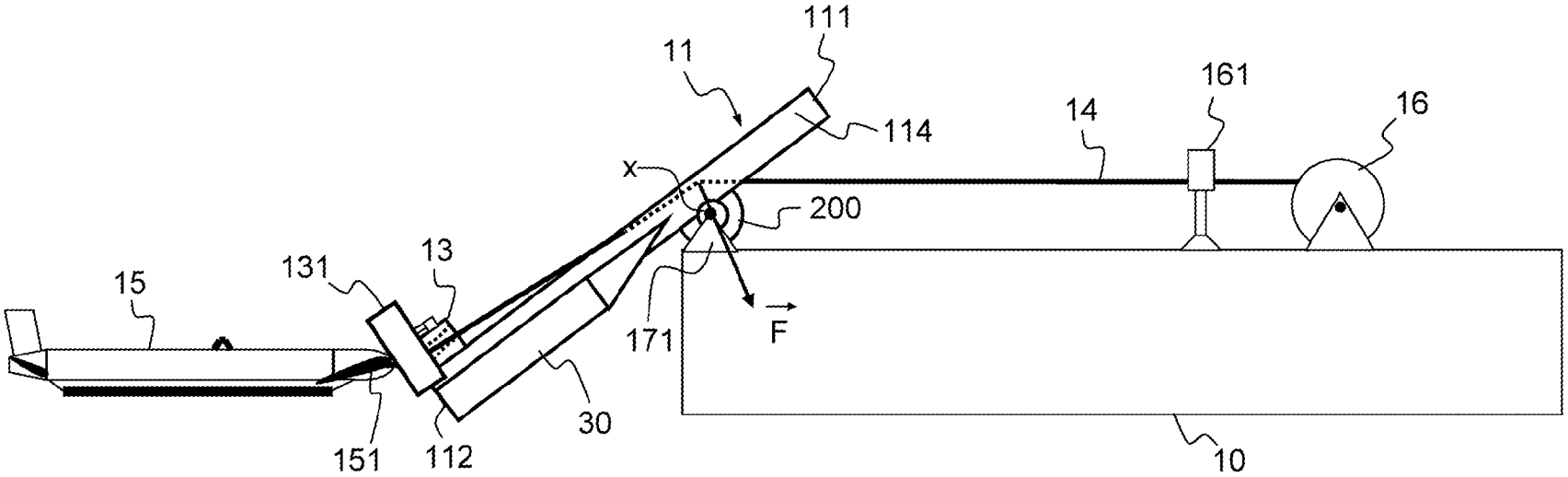

In FIG. 4, the rotation axis x of the ramp with respect to the ship 10 is located at a distance from the emerged end 111. In the embodiment in FIG. 4, the axis x is more particularly located between the end 112 intended to be immersed and the emerged end 111 of the ramp 11. In other words, the rotation axis x is located between the two ends 111, 112 at a distance from these two ends 111, 112. This feature is also reproduced in FIGS. 5, 6 and 7*a* to 7*d*. It makes it possible to move the centre of gravity of the ramp closer to its rotation axis x, thereby making it possible to carry out lifting and lowering operations of the ramp.

In this example, the ramp 11 is provided with floats 30 that are fixed to the edges 114 and 115.

In the example in FIG. 4, as in the preceding example, the system includes means for changing the direction of the cable. These means are arranged so as to send the towing cable 14, and more particularly the part of the cable 14 that is located between the means for changing the direction of changing the direction of the cable and the vehicle 15, in a different direction from the one located between the hauling means 16, 161 and these means for changing the direction of the cable. The means for changing the direction of the cable also play the role of cable deflector.

In this example, the means for changing the direction of the cable include a pulley 200 for changing the direction of the towing cable 14 when the latter comes into contact with the pulley. The circular shape of the pulley ensures circular inflection of the cable. The radius of the pulley is chosen so as to ensure circular inflection of the cable with a radius sufficient not to damage the cable and notably its internal conducting wires. The pulley is arranged such that its axis, known as the pulley axis, is coincident with the rotation axis x of the ramp.

In the example shown in FIG. 1, the means for changing the direction of the cable include a cylinder portion 20, on which the cable 14 is able to slide. The cylinder portion 20 is advantageously a cylinder portion having an opening angle less then 360°.

The cylinder portion 20 is arranged such that its axis is coincident with the rotation axis x of the ramp. The cylinder portion is fixed, either with respect to the ship, or with respect to the ramp. In the example shown in FIG. 1, the cylinder 20 is secured to the ramp and able to move in rotation with respect to the ship about the rotation axis x.

It is also possible to install this type of cylinder portion 20 in the embodiment of FIG. 4 or in one of the following embodiments, in place of the pulley 200.

The fact that the axis of the pulley 200 or of the cylinder portion 20 is coincident with the rotation axis x of the ramp makes it possible to make the movements of the ramp insensitive to the tension in the towing cable 14. This is explained by the fact that the force $\vec{F}$ exerted by the towing cable 14 on the bearing means 20 or 200 and resulting from the tension in the cable passes through the axis of the pulley or of the cylinder portion. Thus, this force passes, in these two examples, through the rotation axis x of the ramp, irrespective of the inclination of the ramp.

Figure 5:
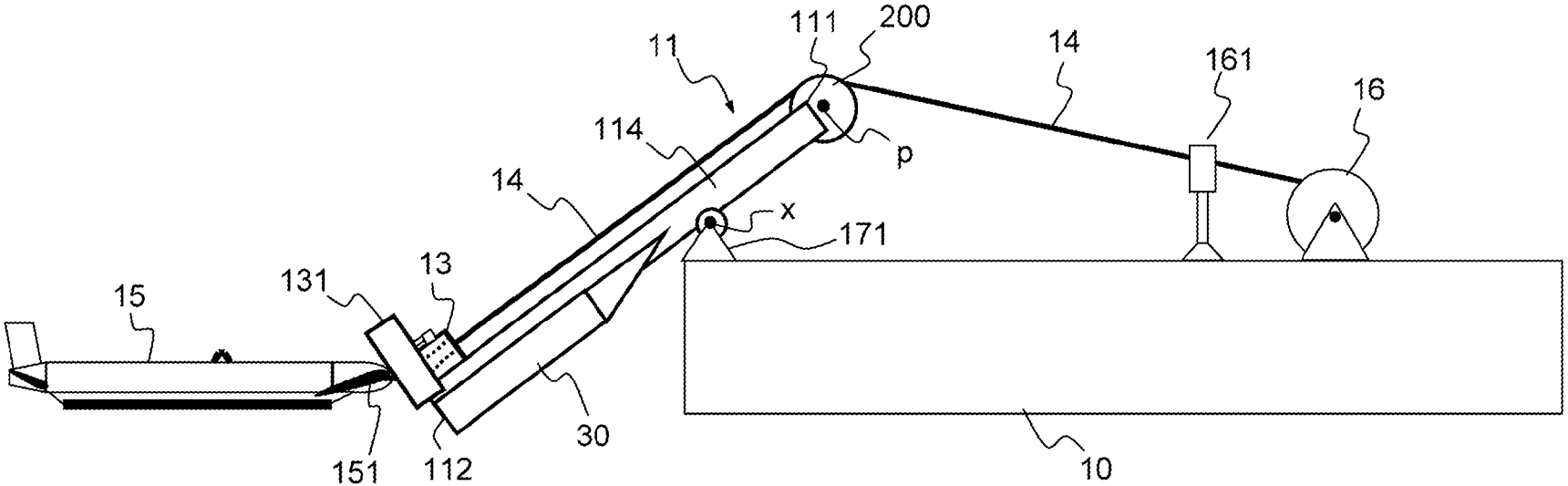

FIG. 5 schematically shows a side view of an example of a system in which the ramp 11 is, just like in FIG. 4, connected to the ship such that the rotation axis x is fixed with respect to the ship by means of fixing means 171. In this example, the means for changing the direction of the cable include a pulley 200. The pulley 200 is positioned on the ramp 11 such that the pulley axis p is located at a distance from the rotation axis x of the ramp. More precisely, in this example, the pulley 200 is mounted at the emerged end 111 of the ramp.

Figure 7A:
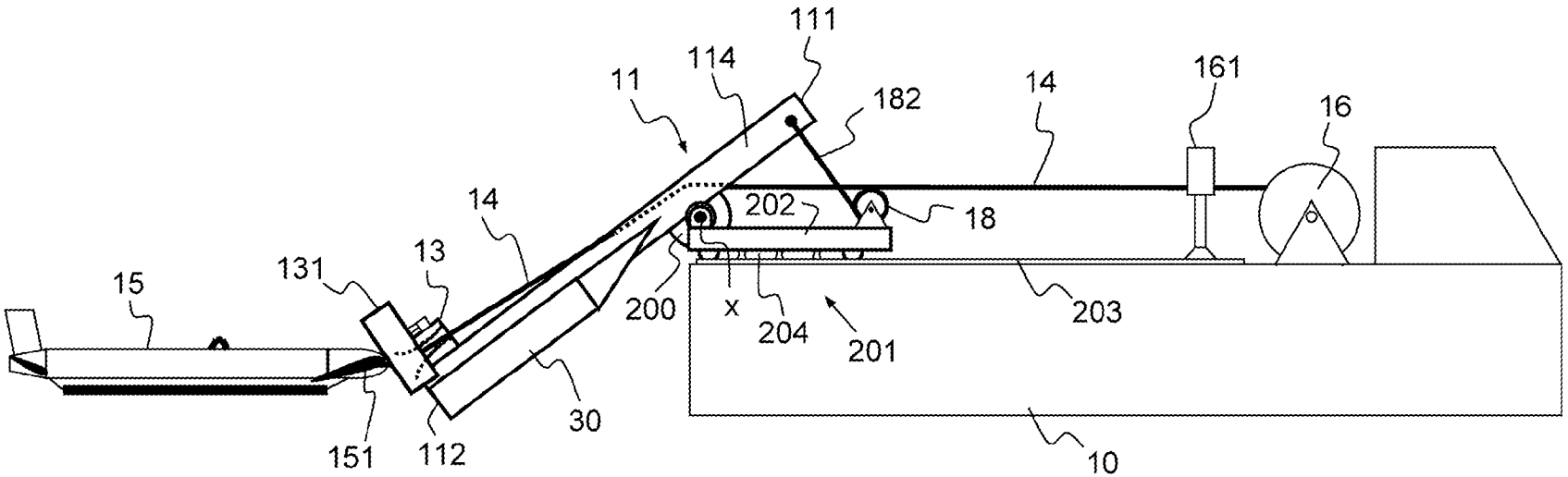
Figure 7B:
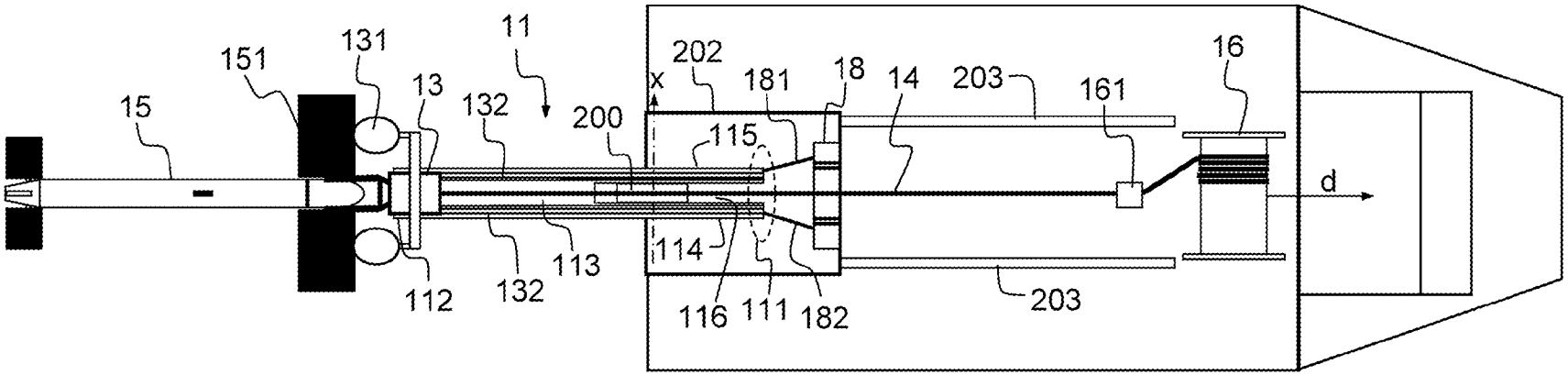

In FIGS. 4 and 5, for reasons of greater clarity, the lifting means for raising and lowering the end 112 of the ramp are not shown. These drive means are conventional means to a person skilled in the art. They may be lifting means such as described hereinabove. Use can also be made of lifting means that include, as can be seen in FIGS. 7*a* and 7*b*, a lifting winch 18 able to wind and unwind two cables 181 and 182 in synchronism. The lifting cables 181, 182 are fixed at the emerged end 111 of the ramp. In the example in FIGS. 7*a* and 7*b*, the lifting cables 181, 182 are fixed to the edges 114, 115 on each side of the indentation 116. This arrangement is best suited to single-hulled ships 10. In this embodiment, the winch 18 is installed in front of the ramp 11.

Figure 6:
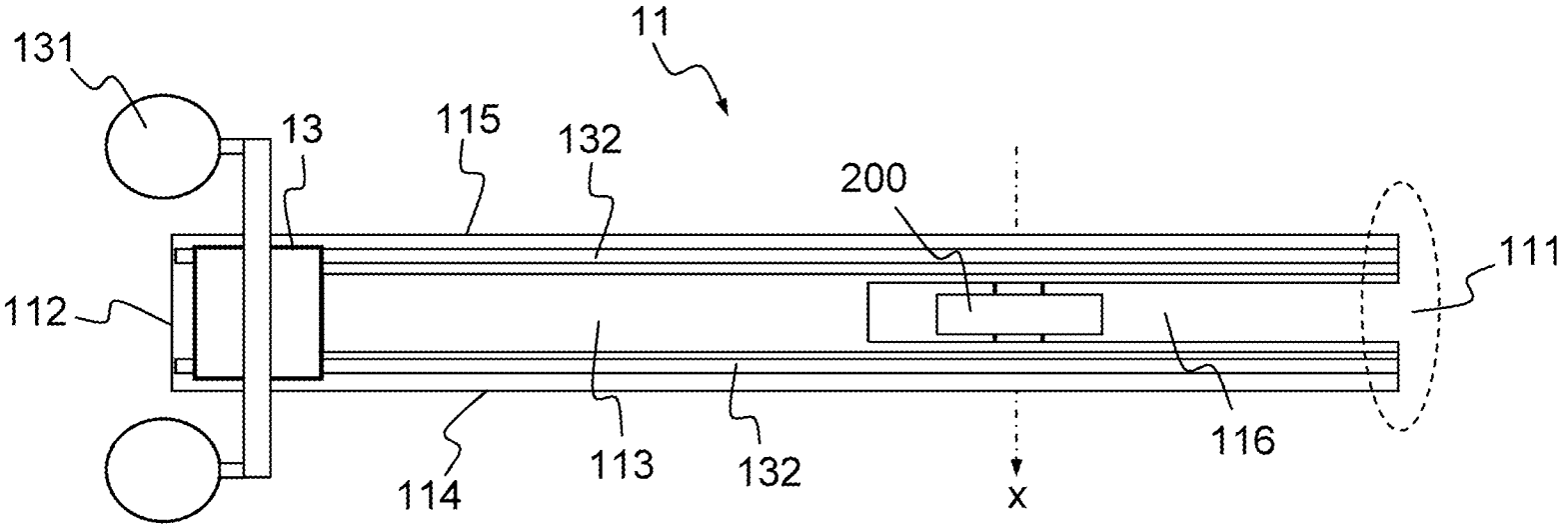

FIG. 6 shows a top view of the ramp 11 from FIG. 4. In this figure, it can be seen that the ramp 11 is in the overall shape of a chute or channel section with a bottom 113 and edges 114 and 115 the height of which is notably determined according to the size and geometry of the vehicle 15 being handled. The bottom 113 has a slot 116 in which the pulley 200 is inserted. The pulley 200 is articulated to the ramp 11 about the rotation axis x.

The slot 116 is arranged such that the part of the cable 14 located between the hauling means 16, 161 and the pulley 200 can pass through the slot. The slot 116 thus allows the towing cable 14 to reach the pulley 200 without diversion between the hauling means 16, 161 of the wire and the pulley 200, no matter whether the ramp is inclined with respect to the horizontal (lowered position) or is in a raised position (that is to say it extends parallel to the horizontal plane). This slot 116 is advantageously present in the embodiment of FIGS. 7*a* to 7*d*.

Figure 2A:
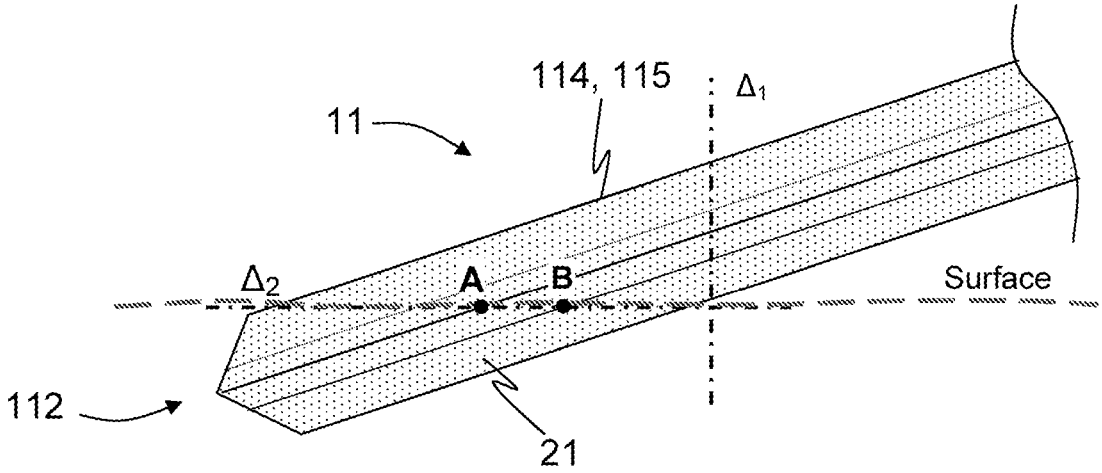
FIGS. 2*a*, 2*b*, 2*c* partial schematic views, in different planes, relating to the hydrodynamic features of the ramp that forms the device according to the invention.
Figure 2B:
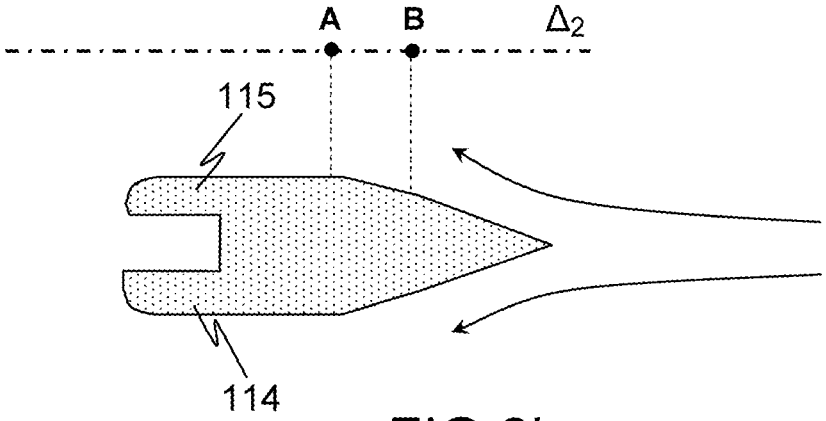
Figure 2C:
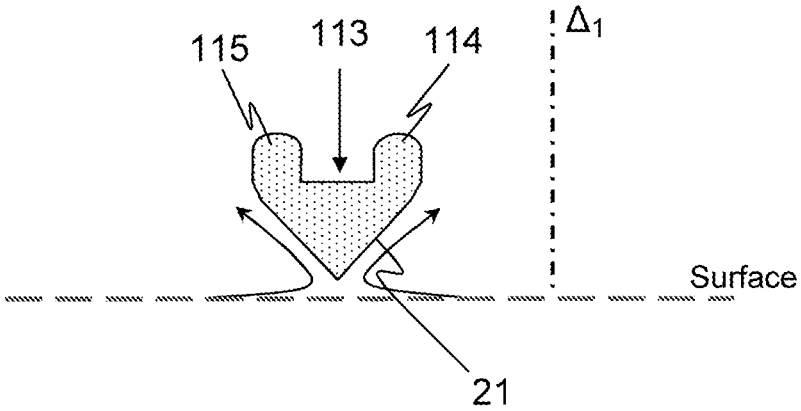

By contrast, the bottom 113 has, as shown in FIGS. 2*a* to 2*c*, a streamlined continuous external face 21, as described hereinabove, on the part of the ramp 11 that can be immersed. In this case, it is the part that is located behind the pulley 200.

FIGS. 7*a* to 7*d* schematically show another embodiment of the system according to the invention. It differs from the one in FIG. 4 in that the rotation axis x of the ramp 11 with respect to the ship 10 is able to undergo translational movement with respect to the ship in a horizontal direction d. In this way, the rotation axis x is able to undergo translational movement with respect to the ship between a first position shown in FIGS. 7*a* and 7*b* and a second position located in front of the first position on the deck of the ship.

In this example, the system according to the invention includes displacement means 201 for displacing the ramp with respect to the ship in a horizontal translational direction d between its first and second positions. This direction d is advantageously located in a plane parallel to the main axis of the ramp.

Advantageously, the displacement means 201 are arranged such that when the rotation axis of the ramp is in its second position, the end 112 does not protrude from the rear of the ship. This makes it possible to protect the ramp while it is being transported by means of the ship 10. In this case, the displacement means 201 include a carriage 202 and rails 203.

In the example of FIGS. 7*a* to 7*d*, the ramp is articulated to a carriage about the rotation axis of the ramp. The carriage 202 is able to undergo translational movement with respect to the ship in the translational direction d between a first position and a second position located in front of the first position on the deck of the ship. More particularly, the carriage is able to move along guide rails 203 that extend in the translational direction d.

In FIGS. 7*a* and 7*b*, the ramp 11 is in the lowered position and the end 112 is immersed. The vehicle 15 is in the water, is hauled by the towing cable 14 and is in contact with the holding element 13 which is disposed at the end 112 of the ramp. The carriage 202 occupies its first position, in which the rotation axis x of the ramp occupies its first position at the rear of the deck of the ship.

Figure 7C:
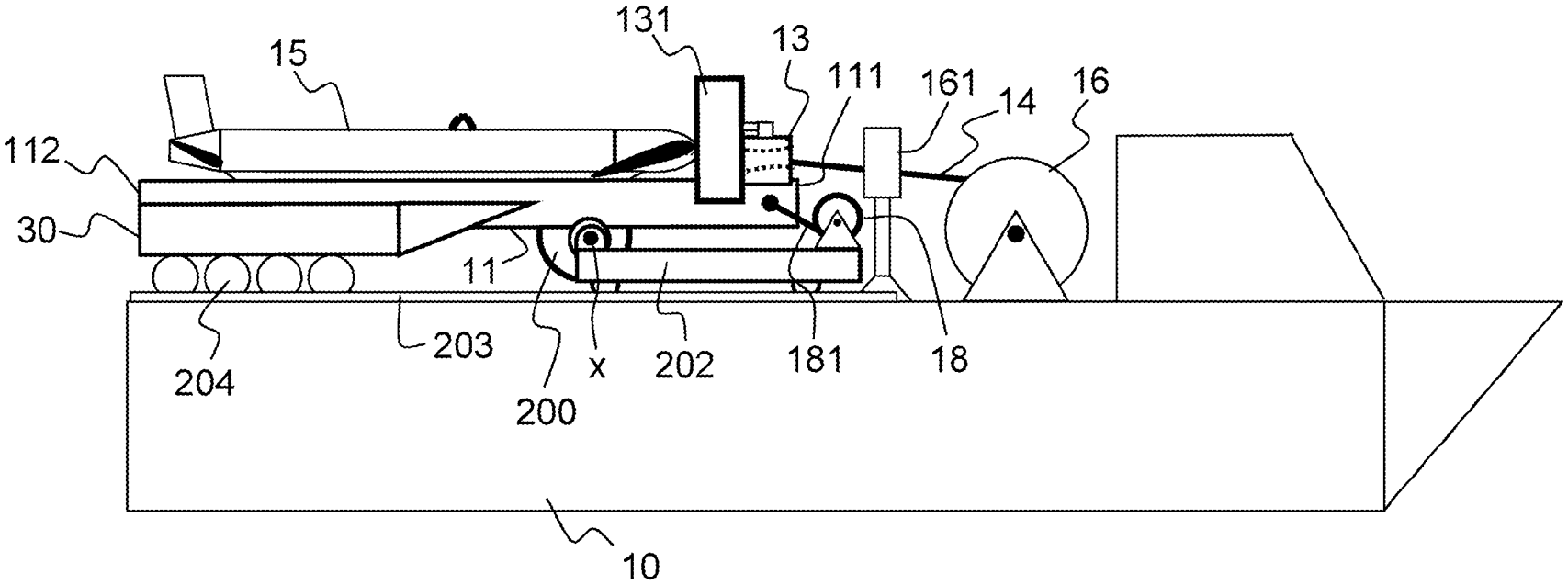
Figure 7D:
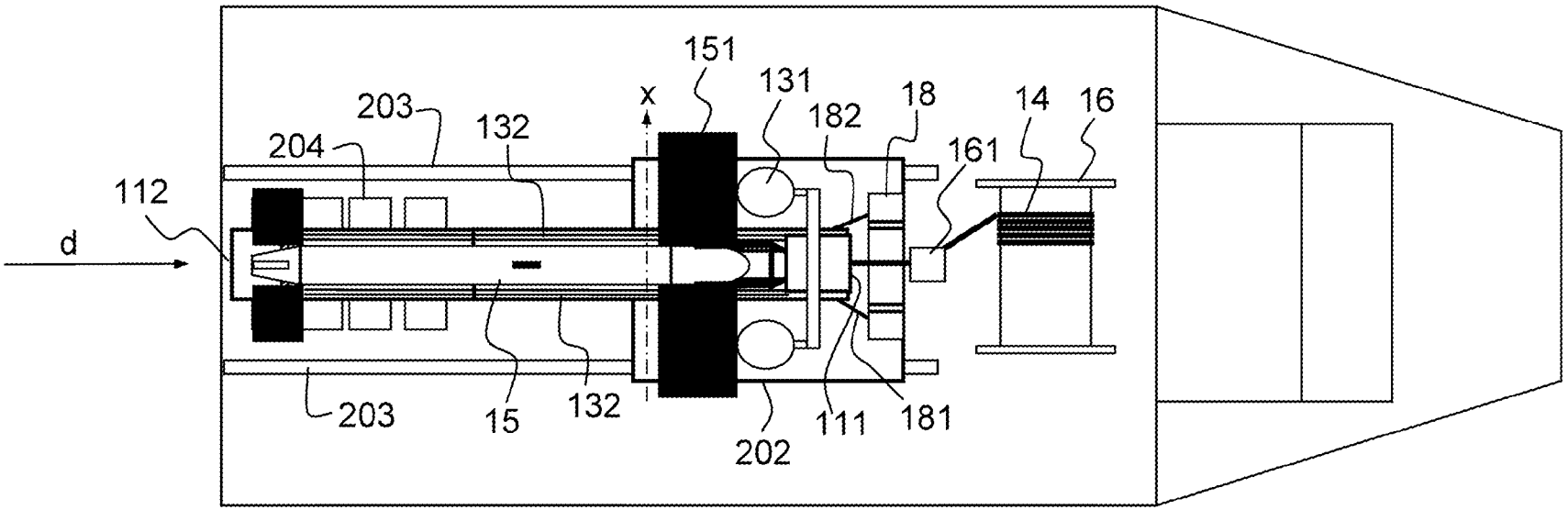

In FIGS. 7*c* and 7*d*, the ramp is in the raised position, and the vehicle 15 has been hoisted onto the ramp. Moreover, the carriage 202 occupies its second position, in which the rotation axis x of the ramp occupies its second position in front of its first position on the deck of the ship 10. The ramp occupies what is known as its storage position.

Advantageously, the device according to the invention includes damping means 204 that are arranged such that the part of the ramp located between its rotation axis and the end 112 rests on these damping means when the carriage occupies its second position. This makes it possible to avoid deterioration of the ramp and to ensure greater stability of the ramp when it is in the raised position.

The invention claimed is:

1. A system for automatically, even in rough seas, launching and recovering a marine or underwater vehicle from an under way carrier ship having wings, system comprising an inclinable articulated ramp in the form of a channel section comprising a bottom and edges and further defining a ramp axis along which the vehicle travels on the ramp; and first drive means for lowering and raising the ramp and hauling means for controlling the sliding of the vehicle along the ramp during the launch and for hoisting the vehicle up along the ramp during recovery, wherein the ramp has an emerged end and a distal end intended to be immersed;

the ramp is mounted for rotation about a horizontal pivot axis perpendicular to the ramp axis so that a the distal end can be raised and lowered in the manner of a drawbridge, the first drive means being able to lower and raise the ramp in such a way that a position of the distal end varies between an immersed position in which the distal end dips down into the water and an emerged position for which the ramp is in a horizontal position;

the rotation axis of the ramp is located at a distance from the emerged end and from the distal end;

wherein the ramp further comprises buoyancy means configured and arranged on the ramp in such a way that the free end of the ramp floats at the surface or near the surface of the water when the ramp is lowered; and wherein the bottom of the articulated ramp has an external face that forms streamlining with a V shaped or W shaped cross sectional profile so as to minimize lift and drag forces imposed on the ramp by the movement of the ship and by vertical dynamic movements caused by waves when its free end is in contact with the water; and further comprising holding and guiding means comprising a holding device to hold an end of the vehicle and remain in contact with the vehicle during the launch and recovery operations, the holding device being driven with the vehicle by the hauling means;

wherein the holding device comprises at least two vertical protection elements on which the wings of the vehicle can rest when the vehicle is engaged in the holding device, the vertical protection elements defining a frontal support plane which is transverse to the ramp axis such that the vertical protection elements provide broad frontal support thus contributing to keeping the vehicle aligned along the ramp axis.

2. The system according to claim 1, wherein the rotation axis of the ramp is located between the emerged end and the distal end intended to be immersed.

3. The system according to claim 1, wherein the edges of the ramp are configured to, jointly with the streamlining of the lower part of the ramp, provide the free end of the ramp with buoyancy.

4. The system according to claim 3, wherein the edges of the ramp are configured to hold the vehicle on the ramp and limit rolling movements imparted to the vehicle.

5. The system according to claim 1, wherein the hauling means comprise a towing cable driven by hauling means.

6. The system according to claim 5, further comprising means for changing the direction of the cable.

7. The system according to claim 6, in which the bottom has a slot, through which the cable is able to pass.

8. The system according to claim 6, wherein the means for changing the direction of the cable include a pulley that has a pulley axis coincident with the rotation axis of the ramp.

9. The system according to claim 6, wherein the means for changing the direction of the cable include a cylinder portion that has an axis coincident with the rotation axis of the ramp.

10. The system according to claim 1, wherein the holding and guiding means further comprise drive means configured to keep the holding device in contact with the end of the vehicle as long as the vehicle is progressing along the ramp.

11. The system according to claim 1, wherein the rotation axis of the ramp is able to undergo translational movement with respect to the ship, between a first position and a second position located in front of the first position with respect to the ship.

12. The system according to claim 11, further comprising damping means on which the part of the ramp that is located between the end that can be immersed and the rotation axis can rest when the ramp is in the second position.

13. The system according to claim 1, further comprising an additional support means for keeping the vehicle in a fixed storage position the additional support means holding the vehicle firmly on the ramp when the ramp is returned to its raised position; the vehicle therefore being stored on the ramp.

* * * * *